United States Patent [19]

Smith

[11] 4,269,313

[45] May 26, 1981

[54] TOOTHPICK HOLDER AND DISPENSER

[76] Inventor: Forrest D. Smith, P.O. Box 3784, Eureka, Calif. 95556

[21] Appl. No.: 77,982

[22] Filed: Sep. 24, 1979

[51] Int. Cl.[3] ..... B65D 85/24

[52] U.S. Cl. ..... 206/380

[58] Field of Search ..... 206/380, 383, 256; 221/312, 255, 288, 303, 311; 215/356, 357

[56] References Cited

U.S. PATENT DOCUMENTS

| | | | |
|---|---|---|---|
| 2,408,902 | 10/1946 | Beckstrom | 206/380 |
| 2,509,150 | 5/1950 | Kassovic | 206/249 X |

*Primary Examiner*—Stanley H. Tollberg

*Attorney, Agent, or Firm*—Bruce A. Jagger

[57] ABSTRACT

A toothpick holder and dispenser that is especially adapted for carrying in the pocket of a user includes an elongated container having an open end and cap member covering the open end. Each member is integrally made of plastic material and has rounded corners to avoid damaging the pocket of the user. The container has a cylindrical main compartment for holding a quantity of toothpicks, and also has one circumferential portion of its exterior wall radially enlarged to provide a discharge compartment. The cap member is rotatable between one position in which it fully covers the discharge compartment and another position in which the discharge compartment is exposed for purpose of withdrawing a toothpick therefrom.

5 Claims, 8 Drawing Figures

TOOTHPICK HOLDER AND DISPENSER

BACKGROUND OF THE INVENTION

The use of toothpicks is long established and widespread. Many different types of toothpick dispensers have been devised. So far as I am aware, however, none of the prior devices has been specially adapted for carrying in the pocket of a user.

According to my invention I provide a combined toothpick holder and dispenser, which is especially adapted for carrying in the pocket of a user.

Thus the object and purpose of the present invention is to provide a pocket type of toothpick holder and dispenser which is economical to manufacture, attractive in appearance, and convenient and easy to use.

DRAWING SUMMARY

DETAILED DESCRIPTION

Figure 1:
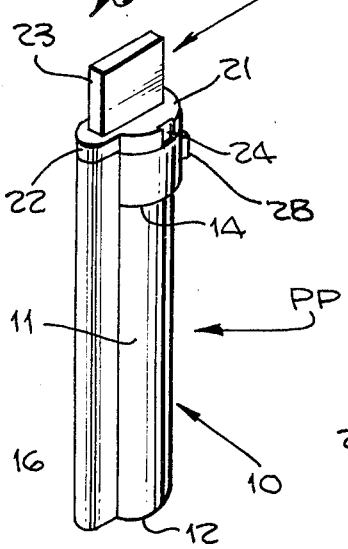
FIG. 1 is a perspective view of my toothpick holder and dispenser.
Figure 3:
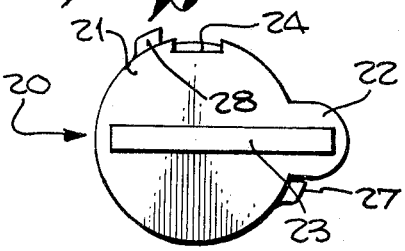
FIG. 3 is a top plan view taken on line 3—3 of FIG. 2.
Figure 4:
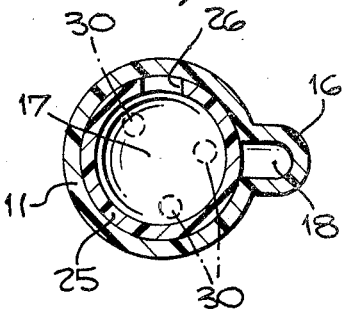
FIG. 4 is a transverse cross-sectional view taken on line 4—4 of FIG. 2.

My new pocket type of toothpick holder and dispenser is very simple in its construction. It consists of only two parts, a container 10 and a cap member 20. Each of these parts is preferably integrally formed of plastic material.

Container 10 is of generally cylindrical configuration, having an exterior wall 11 which is cylindrical except for a radially enlarged portion 16. The wall 11 surrounds a main chamber 17 which is adapted to receive a quantity of toothpicks, while the radially enlarged wall portion 16 provides a discharge compartment 18 that is much smaller and is intended to hold only a single toothpick. The lower end 12 of container 10 is closed in a rounded configuration. The upper end 13 is open. A short distance below the upper end of the container the exterior wall 11 has an outward step which provides an exterior shoulder 14 on its underside and an interior shoulder 15 on its upper side.

Cap member 20 includes a base part 21 that is of a generally flat circular configuration. One circumferential portion of the base part has a radial protuberance 22 formed thereon. The base part of the cap member normally rests on the upper end 13 of the container with the main portion of the base part covering main chamber 17 while the radial protuberance covers discharge compartment 18.

Cap member 20 also has a handle portion 23 that is in the form of a rectangular plate. Handle portion 23 rises up perpendicularly to the base part 21. Handle 23 is so aligned that one end of it extends over the protuberance 22. This arrangement of the handle contributes to the pleasing appearance of the device, as best seen in FIG. 1.

Cap member 20 also has a depending circular portion or skirt 25. The depending portion 25 in its present form is actually cylindrical. One circumferential portion of the skirt 25 is notched at 26. The base part 21 has a notch 24 formed in one portion of its circumference. As best seen from FIGS. 5 and 6 when viewed together, recess 24 in the base part of the cap member is vertically aligned with notch 26 in the skirt.

I prefer to identify my invention by the name POCKET PICKER, and hence the complete device as shown in perspective in FIG. 1 is identified by the initials PP.

OPERATION

The main chamber 17 of container 10 is large enough to hold at least a dozen toothpicks. The cap 20 can simply be lifted out for the purpose of filling the container, and is then replaced. There is a relatively snug engagement between the exterior surface of skirt 25 and the interior surface of circumferential wall 11, and the frictional retaining force is sufficient so that no separate fastening device is needed for keeping the cap member in place. Normally the cap member is rotated to its position, as shown in FIG. 1, where radial protuberance 22 of the cap covers the discharge compartment 18.

Figure 6:
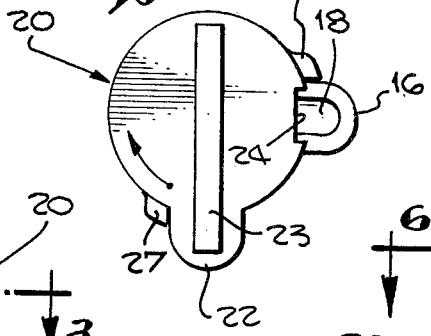
FIG. 6 is a top plan view taken on line 6—6 of FIG. 5.
Figure 2:
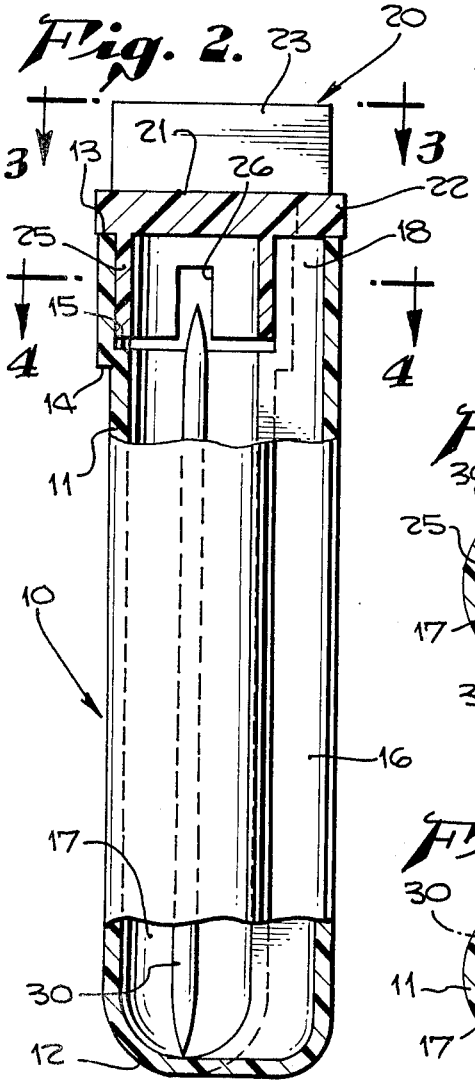
FIG. 2 is an elevation view, partially in cross section.
Figure 5:
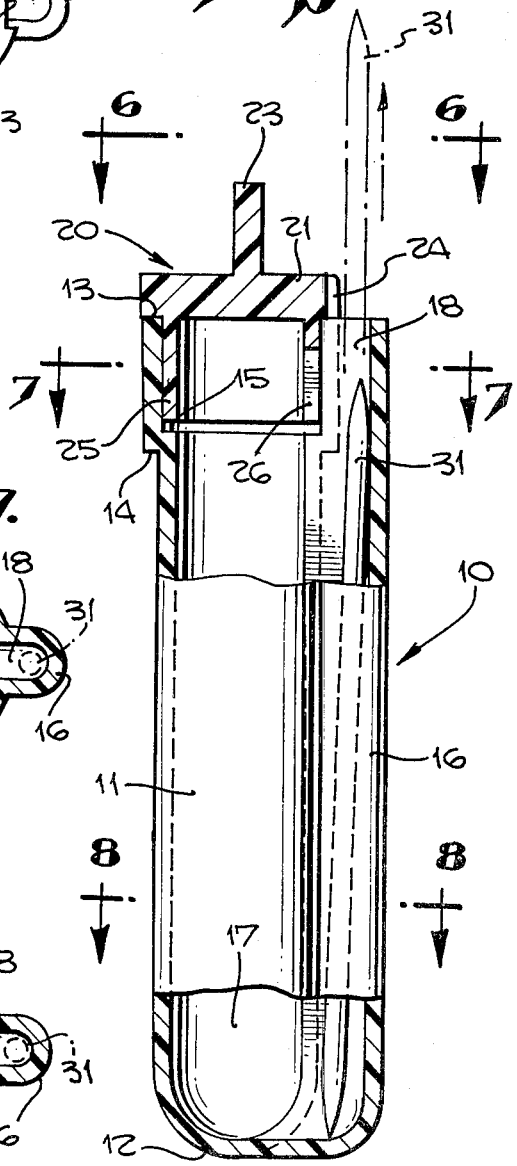
FIG. 5 is a view like FIG. 2, but showing the cap rotated to the discharge position, and a toothpick about to be discharged.
Figure 7:
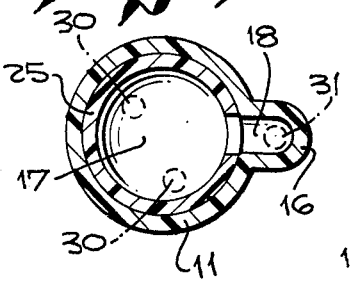
FIG. 7 is a transverse cross sectional view taken on line 7—7 of FIG. 5.
Figure 8:
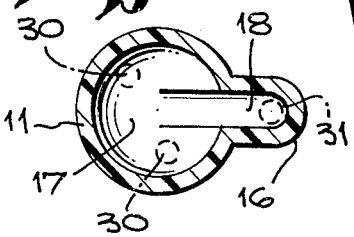
FIG. 8 is a transverse cross sectional view taken on line 8—8 of FIG. 5.

When a toothpick is to be discharged, the cap is rotated approximately ninety degrees to the position shown in FIGS. 5, 6 and 7. Both the notch 26 and the recess 24 of the cap member are now aligned with the discharge compartment. While the main quantity of toothpicks 30 remain in the main chamber 17, the upper end of a particular toothpick 31 is now permitted to fall through the notch 26 and into the upper end of the discharge chamber. See FIG. 5. The device is then inverted and the single toothpick drops out. Then the cap is rotated back to its normally closed position.

Cap member 20 is preferably provided with stops 27 and 28 which limit the rotation of the cap between the open and closed configurations. Stops 27 and 28 project downwardly from the cap member 20 so as to engage radially enlarged wall portion 16 in the respective open and closed configurations.

ALTERNATE FORMS

In the particular embodiment shown I incorporated in the cap a protuberance 22 which covers the discharge chamber, and a recess 24 that fully exposes the discharge chamber. If desired, the diameter of the cap may be larger so that every portion of it will cover the discharge chamber, except for a single circumferential portion that is recessed so as to fully expose the chamber. Alternatively, the entire cap may be made smaller so that any portion of it will expose the discharge chamber, except for a particular poriton having a protuberance large enough to cover the chamber.

In the particular embodiment the cap member seats within the upper end of the container 10. If desired, however, the cap member may be made to fit over the outside of the container. The depending skirt of the cap member will then engage the exterior surface of the container, and the skirt must have a circumferential notch of sufficient width to fit over the discharge chamber and also to permit enough rotation so that the cap member may close the discharge chamber in one position while fully exposing it in another.

The invention has been described in considerable detail in order to comply with the patent laws by providing a full public disclosure of at least one of its forms. However, such detailed description is not intended in any way to limit the broad features of principles of the invention, or the scope of patent monopoly to be granted.

What is claimed is:

1. A pocket type toothpick holder and dispenser comprising:

a generally cylindrical container which is closed at one end and open at the other, said container being of sufficient size to longitudinally receive a quantity of toothpicks therein;

a cap member disposed on said open end of said container in free rotatable relation therewith and including a base part which fits over the end of said container and a depending circular portion which extends within the open end of said container;

said container being radially enlarged at one circumferential portion thereof to provide a discharge compartment running the full length of said container and which is of sufficient size to loosely receive a single toothpick, said discharge compartment being open at the open end of said container; and the base part of said cap normally at least partially closing the open end of said discharge compartment, said base part at one circumferential portion having a recess in said base part for communicating with said discharge compartment, said base part of said cap including a radial protuberance thereon for covering the open end of said compartment in a particular rotational position of said cap member; the remaining circumference of said cap, except for said recess, being of about the same diameter as said container;

whereby upon rotating said cap to align said recess with said discharge compartment a single toothpick may be withdrawn from said container through the open end of said discharge compartment.

2. Apparatus as in claim 1 wherein said cap member has an axially extending handle portion.

3. Apparatus as in claim 1 wherein said cap member has a flat handle portion rising up from said base part and perpendicular thereto, said handle portion extending over said radial protuberance.

4. Apparatus as in claim 1 wherein said container is integrally formed of plastic material and said cap member is also integrally formed of plastic material.

5. A pocket-type toothpick holder and dispenser comprising, in combination:

a container integrally formed of plastic material and which has an elongated generally cylindrical configuration, said container having a bottom end which is closed and a top end which is open, the height of said container being greater than the length of a toothpick, said container providing a cylindrical main compartment and its exterior wall being radially enlarged at one circumferential portion thereof to also provide a discharge compartment that runs the full height of said container and which is of sufficient size to loosely receive a single toothpick therein, the lower end of said container being smoothly rounded to avoid damaging the pocket of a user, and the exterior wall being outwardly stepped near the upper end of said container to provide interior and exterior shoulders which extend circumferentially between the opposite sides of said discharge compartment; and a cap member integrally formed of plastic material, said cap member including a base part that is of generally flat circular configuration with a radial protuberance formed on one circumferential portion thereof, said base part being of such size as to rest upon the upper end of said container and close both the main compartment thereof and the discharge compartment thereof, said cap member also having a cylindrical skirt depending from the underside of said base, said skirt being adapted to be rotatably received by the interior wall of said container above said interior shoulder thereof and in frictional retaining relationship therewith, said skirt having one circumferential portion thereof notched on its underside to permit the upper end of a toothpick to pass from said main chamber of said container to said discharge compartment thereof, said base part of said cap member also having a notch formed in its circumferential edge and circumferentially aligned with said notch in said skirt, and said cap member also having a handle portion in the form of a rectangular plate which rises perpendicularly above said base part, said handle portion being so aligned that one of its ends extends over the radial protuberance in said base part, and the corners of said handle portion being smoothly rounded to avoid damaging the pocket of a user; and said cap member being axially removable from said container for inserting a supply of toothpicks therein;

whereby in one rotational position of said cap member said radial protuberance of said base part covers said discharge compartment, and in another rotational position of said cap member said notch in said base part exposes said discharge compartment so that a toothpick may be withdrawn therefrom.

* * * * *